US011628482B2

(12) United States Patent
Pezzuto

(10) Patent No.: US 11,628,482 B2
(45) Date of Patent: Apr. 18, 2023

(54) MULTIFUNCTION WORK APPARATUS

(71) Applicant: M.E.P.—MACCHINE ELETTRONICHE PIEGATRICI S.P.A., Reana del Rojale (IT)

(72) Inventor: Patrizia Pezzuto, Udine (IT)

(73) Assignee: M.E.P.—MACCHINE ELETTRONICHE PIEGATRICI S.P.A., Reana del Rojale (IT)

( * ) Notice: Subject to any disclaimer, the term of this patent is extended or adjusted under 35 U.S.C. 154(b) by 0 days.

(21) Appl. No.: 16/463,297

(22) PCT Filed: Nov. 22, 2017

(86) PCT No.: PCT/IB2017/057333
§ 371 (c)(1),
(2) Date: May 22, 2019

(87) PCT Pub. No.: WO2014/809646
PCT Pub. Date: May 31, 2018

(65) Prior Publication Data

US 2019/0337037 A1 Nov. 7, 2019

(30) Foreign Application Priority Data

Nov. 22, 2016 (IT) ..... 102016000117662

(51) Int. Cl.
*B21D 3/05* (2006.01)
*B21D 43/00* (2006.01)
(Continued)

(52) U.S. Cl.
CPC ..... *B21D 3/05* (2013.01); *B21D 43/006* (2013.01); *B21F 1/02* (2013.01); *B21F 23/00* (2013.01)

(58) Field of Classification Search
CPC ..... B21D 3/05; B21D 43/006; B21D 3/00; B21D 3/02; B21F 1/02; B21F 23/00;
(Continued)

(56) References Cited

U.S. PATENT DOCUMENTS 5,586,709 A * 12/1996 Del Fabro ..... B21B 13/005 226/177
2016/0016216 A1* 1/2016 Del Fabro ..... B21C 19/00 72/205

FOREIGN PATENT DOCUMENTS

CN 201470721 U * 5/2010
CN 202146959 U 2/2012
(Continued)

OTHER PUBLICATIONS

Machine translation of CN-201470721-U (Year: 2010).*
International Search Report and Written Opinion for PCT/IB2017/057333, dated Mar. 5, 2018.

*Primary Examiner* — Shelley M Self
*Assistant Examiner* — Teresa A Guthrie
(74) *Attorney, Agent, or Firm* — Marshall, Gerstein & Borun LLP

(57) ABSTRACT

A multifunction work apparatus includes a drawing and yielding assembly and at least one of either a wire guide assembly, a straightening assembly, or a finishing assembly. The drawing and yielding assembly includes a contrast roll, rotatable idly around its axis of rotation, and at least two motorized rolls positioned on the periphery of said contrast roll.

19 Claims, 3 Drawing Sheets

(51) Int. Cl.
*B21F 1/02* (2006.01)
*B21F 23/00* (2006.01)

(58) Field of Classification Search
CPC .. B21F 1/00; B21F 23/002; B21F 9/00; B21F 9/002; B21B 39/006; B21B 2015/0028; B21B 2015/0071; B21C 19/00
USPC ..... 72/160, 162–164, 205
See application file for complete search history.

(56) References Cited

FOREIGN PATENT DOCUMENTS

| | | | | |
|---|---|---|---|---|
| CN | 102328007 | B | | 7/2013 |
| CN | 103056246 | B | * | 12/2014 |
| EP | 0824982 | A1 | | 2/1998 |
| EP | 2949407 | A1 | | 12/2015 |
| JP | 2007229745 | A | | 9/2007 |
| WO | WO-2010/043611 | A1 | | 4/2010 |
| WO | WO-2014/132207 | A1 | | 9/2014 |

* cited by examiner

MULTIFUNCTION WORK APPARATUS

FIELD OF THE INVENTION

The present invention concerns a multifunction work apparatus.

In particular, the multifunction work apparatus according to the present invention can be used for yielding, or stretching, linearizing and possibly, or also, for measuring metal wires.

The multifunction work apparatus according to the present invention is applied, preferably but not exclusively, in association with machines, or plants, to obtain shaped metal wires, such as brackets for the building trade of any type, linearized wires or suchlike.

Here and hereafter in the description and the claims, the term "wire" includes a bar with a round section, or a section bar with a square or polygonal section, or rods for the building trade, with sizes or diameter comprised for example between 3 mm and 25 mm, or more, variable according to the size of the apparatus.

BACKGROUND OF THE INVENTION

Multifunction work apparatuses are known, for yielding and linearizing metal wires, but which have operational and functional limits.

Multifunction work apparatuses are also known, provided with a drawing assembly, with the function of drawing the metal wires and which also measures the length of the advancing wire.

One example of a work apparatus is described in document WO-A-2014/132207, which describes a drawing and straightening assembly comprising a motorized roll and at least two contrast rolls which can be rotated idly around their axes of rotation, positioned on the periphery of the motorized roll to define a passage gap for the wire, and in which the motorized roll has a larger diameter than the diameter of the contrast rolls.

Work apparatuses are also known in which the drawing assembly can also have, or performs, the function of yielding the metal wires in order to straighten them.

Alternatively, or in combination, it is provided that the yielding action is carried out by at least one straightening assembly, generally located upstream of the drawing assembly and provided with alternating and opposite rolls, with respect to the feed axis of the wires, to generate one or more straightening loops.

It is also known that the multifunction work apparatuses can also be configured to work several metal wires at a time, normally two.

One disadvantage of such known apparatuses is that, if it is required to pass from a configuration in which the apparatus works two or more wires, to one working a single wire, or vice versa, changes or modifications of the apparatus are required which require the intervention of operators, with consequent loss of time.

Another disadvantage of multifunction work apparatuses is that they do not allow to work wide ranges of sizes or types of metal wires processed.

Another disadvantage of known multifunction work apparatuses is the rapid wear process to which, for example, the drawing rolls are subjected.

Other disadvantages are the maintenance and the spare parts as well as the initial problems of assembly and fine tuning.

Other disadvantages of known solutions are the not always correct measurement, in length, of the wire in transit and/or the incorrect straightening and linearization.

It is from this existing situation that Applicant set himself the problem of studying, experimenting and producing a very versatile multifunction work apparatus able to operate not only in association with the most advanced stirrup-making machines, but also with those that operate on a wide range of wire size.

Another purpose is to operate with shaping or coiling machines.

Another purpose is to at least reduce the wear of the rolls or the waste of material to be linearized.

Another purpose of the present invention is to provide a simple and compact multifunction work apparatus that is easy to operate and to reciprocally position the components.

It is also a purpose of the present invention to provide a multifunction work apparatus that requires simple assembly and simple and easy maintenance interventions. It is also a purpose to provide a multifunction work apparatus that can be easily implemented according to the final result.

It is also a purpose of the present invention to provide a multifunction work apparatus able to satisfy the maximum speeds of machines downstream.

It is also a purpose of the present invention to provide a multifunction work apparatus suitable for operating upstream of apparatuses designed to obtain a wide range of products such as straight wires, stirrups, spiral wires, shaped wires, etc.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, a drawing and yielding assembly in accordance with the present invention comprises a contrast roll, rotatable idly around its axis of rotation, and at least two motorized rolls positioned on the periphery of the contrast roll to define passage gaps for the passage of wires. The contrast roll has a larger diameter than the diameter of the motorized rolls.

This configuration of the drawing and yielding assembly allows to increase the drawing action that the assembly is able to exert on the product being worked compared to the state of the art.

The present invention also concerns a multifunction work apparatus comprising a drawing and yielding assembly as described above and at least one of either a wire guide assembly, a straightening assembly, or a finishing assembly.

Embodiments of the present invention also concern a multifunction work apparatus that comprises at least two of the following assemblies:

- a drawing and yielding assembly, for example of the type described above, suitable to operate, according to the operating condition, selectively on one wire or on two wires at the same time to both feed them toward an apparatus located downstream and also to obtain a desired yielding effect;
- a wire guide assembly with rolls configured to guide the introduction of one or two metal wires into the multifunction work apparatus at the same time, and to position the front part of the metal wires in the correct position to feed the subsequent assembly;

a straightening assembly, also called pre-yielding assembly, located upstream of the drawing and yielding assembly, and configured to induce an at least initial yielding of one or both of the metal wires and to prepare them in the best conditions for the subsequent yielding action exerted by the drawing and yielding assembly;

a finishing assembly with the function of guaranteeing the linearity of the exiting wire.

This combination, even in its minimum structure, also allows to solve a plurality of technical problems, at the same time conferring correlated advantages:

- it allows to obtain a machine which is progressively always more complete and suitable to obtain the best linearization;
- it allows to simplify the mounting, maintenance and regulation;
- it guarantees a complete and exhaustive yielding of the metal wires;
- it allows to obtain a stabilized linearization without substantial residual tensions in the wire;
- it allows to work indiscriminately two wires simultaneously and respectively one wire and the other wire present in one guide channel or the other, without causing anomalous wear on the rolls, and to reduce and even eliminate downtimes of the machine due to the passage from a condition where it is working one wire to a condition where it is working two wires, or vice versa;
- it allows to work, even up to 12-15 m/sec, a wide range of wire diameters;
- it allows to obtain lengths of the wires fed that are not affected by slippages of the drawing wheel and wire;
- it allows a very quick regulation and preparation;
- it allows to obtain a finished linearization much above the average;
- it facilitates the introduction of the wires, feed control and regulation, even during drawing-in;
- it allows quick and simple maintenance operations.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
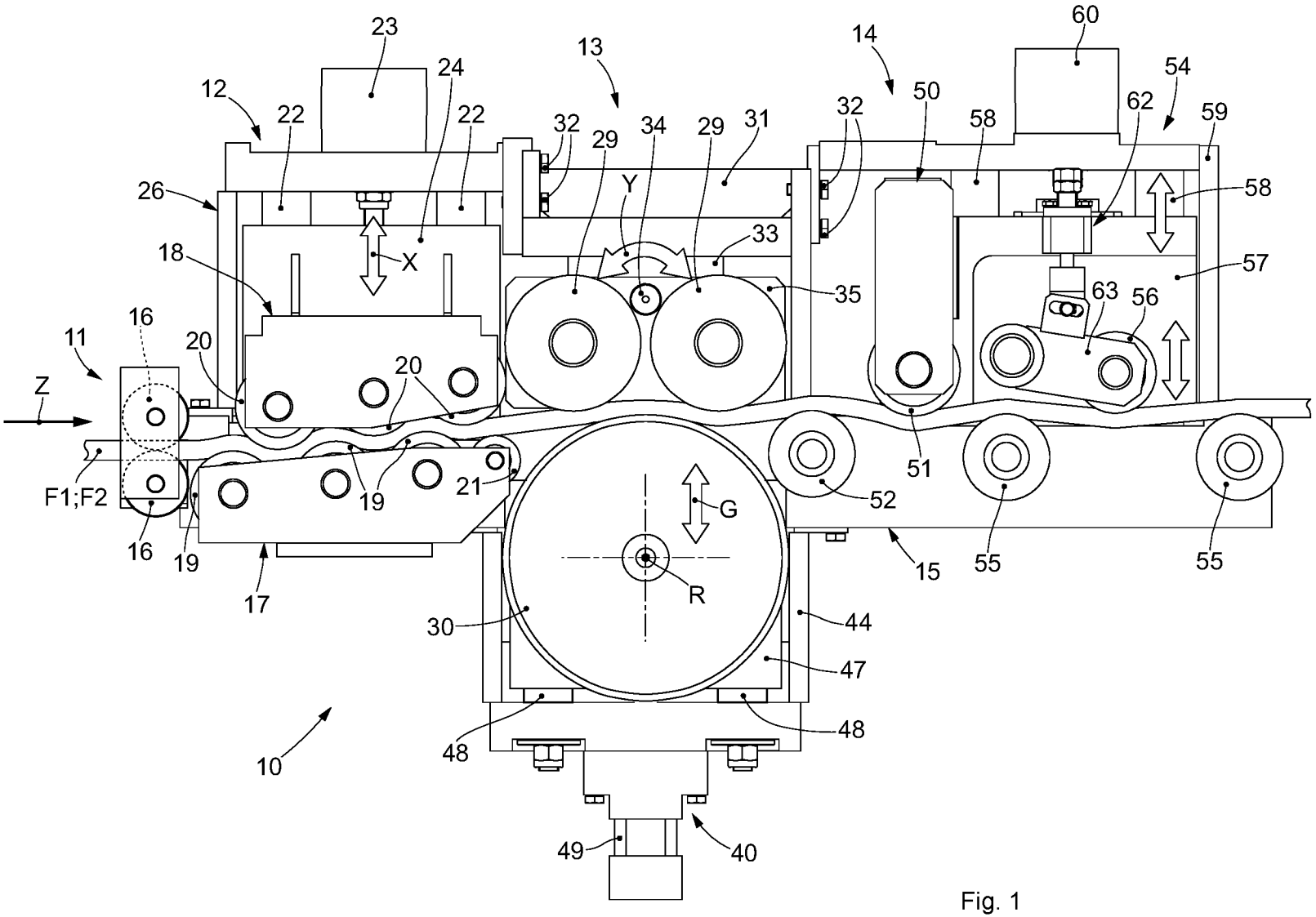
FIG. 1 is a front view, operating side, of an embodiment of the invention.

With reference to FIG. 1, a multifunction work apparatus 10 comprises a plurality of autonomous, correlated and functionally cooperating assemblies 11-14, which allow for ease of storage, transport, maintenance and assembly.

Each assembly is functional to at least one of the subsequent ones, and the combination of the assemblies represents the inventive idea in its widest extension.

In the solution given by way of example, the assemblies 11-14 are located in sequence along a work direction Z and, in this case, are directly or indirectly connected stably to a single base frame 15 which, for example, is part of a frame (not shown), suitably prepared according to the configuration required on each occasion by the user.

Figure 5:
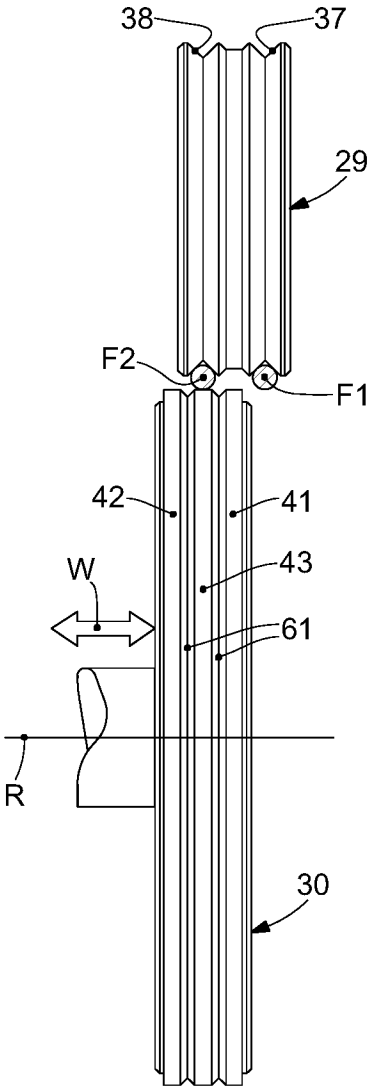
FIGS. 3, 4 and 5 show possible operating conditions of a part of the apparatus of the present invention.
Figure 4:
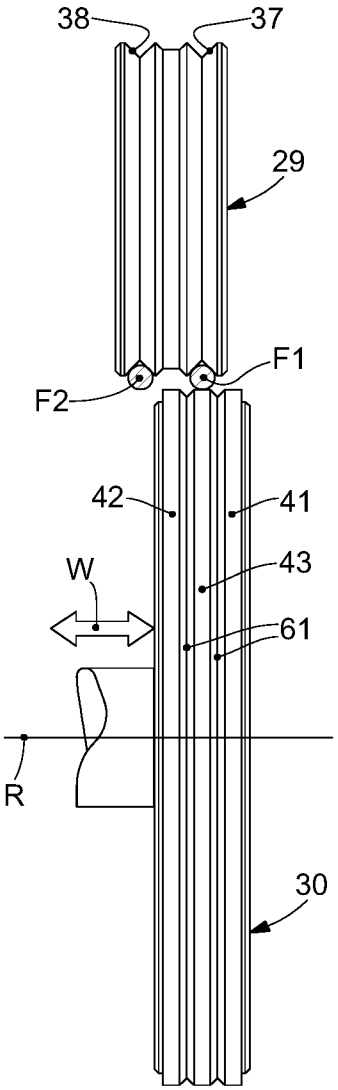
Figure 3:
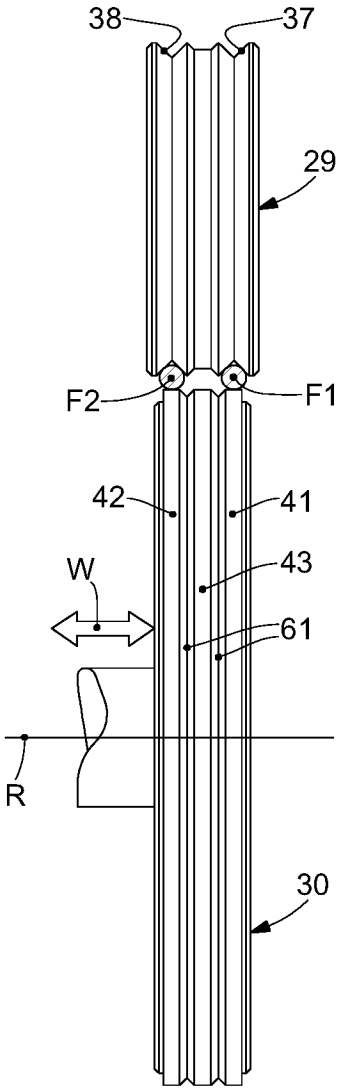

The multifunction work apparatus 10 can be functionally connected upstream and/or downstream with other feed assemblies, coil unwinders, stores, operating machines, etc. in relation to the final result to be obtained in the metal wires, for example the wires F1 and F2 shown in FIGS. 3-5.

The multifunction work apparatus 10 described with reference to the attached drawings is configured to work two wires F1 and F2, although it is not excluded that, with normal adaptations, the apparatus can be configured to work even more than two wires, for example three or four wires.

The multifunction work apparatus 10 can work:

two wires F1 and F2 simultaneously in the same way;

two wires F1 and F2, one of which is completely linearized, the other mainly yielded and linearized;

a single wire F1 or F2.

The multifunction work apparatus 10, in its entirety, comprises a wire guide assembly 11 located upstream of the whole apparatus and which receives the wires F1 and F2 and correctly directs them into the next assembly.

The wire guide assembly 11 is provided with at least one pair of wire-guide rolls 16 disposed in an opposite position with respect to the work direction Z and defining guide gaps for the guided passage of the wires F1 and F2.

The wire guide assembly 11 can have means to adjust the median position, with respect to the work direction Z, and to position the wire guide rolls 16 in a desired position with respect to the next assembly.

The wire guide rolls 16 can be advantageously provided with guide grooves which together define at least two guide gaps to allow the guided introduction of the two wires F1 and F2 in both the coordinated axes orthogonal to the work direction Z.

The multifunction work apparatus 10 also comprises a straightening assembly 12, also known as pre-yielding assembly, to induce a desired pre-yielding on the wires F1 and F2.

The straightening assembly 12 is provided, at the bottom, with a first roll assembly 17, in this case installed in a fixed position with respect to the base frame 15 and, at the top, with a second roll assembly 18, opposite to the first roll assembly 17, in this case, able to be positioned in a direction orthogonal to the work direction Z, in the direction indicated by the arrow X in FIG. 1, to cooperate with the first roll assembly 17.

The first roll assembly 17 and the second roll assembly 18 are provided respectively with first straightening rolls 19 and with second straightening rolls 20, opposite to the first straightening rolls 19 with respect to the work direction Z. In particular, the second straightening rolls 20 are positioned alternately, in the work direction Z, to the first straightening rolls 19, thus generating a plurality of straightening loops, desired and controlled, for the wires F1 and F2 which are made to transit.

In the case shown, the first roll assembly 17 has a plurality of first straightening rolls, in this case three first straightening rolls 19 and an exit roll 21, but it could also have all first straightening rolls 19, or even more rolls, if it has to work large wires or very crooked wires.

Similarly, the second roll assembly 18 can have a number of rolls coordinated with that of the first roll assembly 17.

The second roll assembly 18 slides on guides 22 located transversely to the work direction Z.

A positioning member 23 can be associated with the second roll assembly 18 and is provided to move the second roll assembly 18 along the guides 22.

The straightening assembly 12 comprises a frame 26 integral with the base frame 15 and on which the second roll assembly 18 and the guides 22 are installed.

The positioning member 23 can comprise an oil-dynamic or electromechanical jack, cooperating with a computerized system that controls its position and possibly also the force exerted by the second roll assembly 18 on the wires F1, F2 in a direction transverse to the work direction Z.

The second roll assembly 18 can be installed on a chock 24 which, in turn, is connected to the positioning member 23 which conditions, both fixedly and variably, according to the point-by-point requirements of the wires F1 and F2 in transit, the position of the second roll assembly 18. The second roll assembly 18 can be disassembled from the chock 24, for example to allow a quick replacement of the rolls.

The first straightening rolls 19 and the second straightening rolls 20 can be provided with guide grooves 25 (FIG. 2) to contain the wires F1 and F2.

Figure 2:
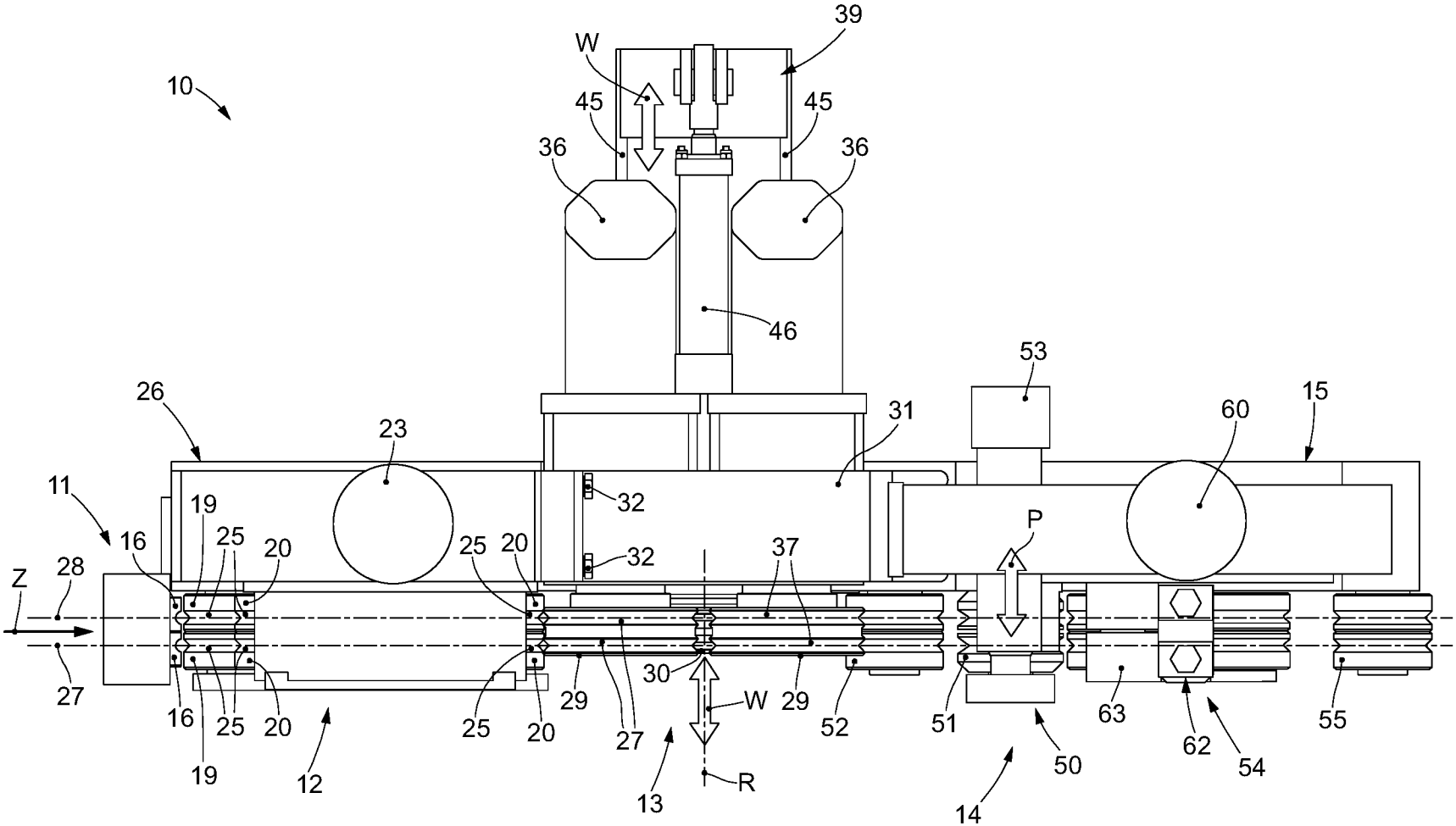
FIG. 2 is a plan view from above of FIG. 1.

In particular, it can be provided that the first straightening rolls 19 and the second straightening rolls 20 define a first guide channel 27 and a second guide channel 28, identified by the lines of dots and dashes in FIG. 2, respectively for the passage of the wire F1 and wire F2.

In accordance with the embodiment shown in FIG. 2, it can be provided that pairs of the first straightening rolls 19 and pairs of the second straightening rolls 20 are installed idle on the same axis of rotation to dispose the respective guide grooves 25 adjacent to each other.

According to a possible solution, the rolls of the pairs can be independent from each other and both are idle with respect to the other. In this case, the drawing action exerted only on one of the wires F1 and F2 does not affect the advance of the adjacent wire.

The multifunction work apparatus 10 comprises a drawing and yielding assembly 13 located downstream of the straightening assembly 12 and configured to exert a drawing and yielding action such as to linearize the wires F1 and F2.

The drawing and yielding assembly 13 comprises a contrast roll 30 which can rotate idly around its axis of rotation R, and at least two motorized rolls 29 positioned on the periphery of the contrast roll 30 and cooperating with it to define passage gaps for the wires F1, F2.

In particular, the motorized rolls 29 and the contrast roll 30 define the continuation of the first guide channel 27 and the second guide channel 28 for the passage of the wires F1 and F2.

Furthermore, the contrast roll 30 has a larger diameter than the diameters of the motorized rolls 29.

The presence of two motorized rolls 29 in cooperation with the contrast roll 30 allows at least the following advantages compared to known solutions:

- it allows to increase the drawing capacity of the wires F1, F2, a particularly important condition in the case of large-caliber wires,
- it induces desired stresses, for example drawing stresses on the wires F1, F2, to increase the action of straightening and linearization of the wires themselves;
- it requires the application of lower drawing powers on the wires F1, F2, since this power is distributed on the two motorized rolls 29,
- as a consequence of the previous point, it reduces the wear on the rolls, and consequently the frequency of maintenance.

The motorized rolls 29 both have the same diameter, although it cannot be excluded that, in possible variant embodiments, they can have different diameters, for example in the case where it is intended to process wires F1, F2 with different diameters.

According to possible embodiments, the contrast roll 30 has a diameter comprised between 1.5 and 3, preferably between 1.8 and 2.5, times the diameter of the motorized rolls 29.

This ratio in size between the motorized rolls 29 and the contrast roll 30 allows to maximize the yielding and straightening results of the wires F1 and F2.

According to a possible embodiment, the contrast roll 30 can have a diameter comprised between 120 mm and 320 mm and the motorized rolls 29 can have a diameter comprised between 35 mm and 200 mm.

In accordance with a possible solution, the contrast roll 30 and the motorized rolls 29 can have a substantially equal thickness.

A detection device, for example an encoder, can be associated with the contrast roll 30, configured to detect the lengths of the wires F1 and F2 fed to the assemblies downstream.

The association of the detection device with the contrast roll 30 allows to obtain a precise and safe detection of the length of the wires F1, F2 processed, since the contrast roll 30, being idle, is not subject to slippage due, for example, to a drawing action.

According to some formulations of the present invention, the first straightening rolls 19 and the exit roll 21 are located, with respect to the work direction Z, on the same side of the contrast roll 30.

The exit roll 21 is located in direct proximity to the drawing and yielding assembly 13 and is configured to define, with a first of the motorized rolls 29, a loop which winds around the first motorized roll 29.

In particular, the exit roll 21 allows to increase the angular winding amplitude of the wire F1 and F2 around the first motorized roll 29, increasing the drawing action of the wires F1 and F2 and reducing the risk of slippage.

The drawing and yielding assembly 13 comprises a frame 31 which anchors itself, with locking elements 32, to the frame 26 of the straightening assembly 12, to obtain a solid structure which is not reciprocally mobile during working.

A fixed chock 33, vertically adjustable in position, is anchored to the frame 31 and supports, in a horizontally pivoting manner in the direction indicated by the arrow Y, around a pin 34, a pivoting chock 35. The pin 34 has a pivoting axis parallel to the axes of rotation of the motorized rolls 29.

The oscillation of the pivoting chock 35 around the pin 34 can be free or contrasted by means, for example, having an elastic function (springs, pistons, leaf springs, etc.).

The two motorized rolls 29 are installed on the pivoting chock 35. In particular, it is provided that the two motorized rolls 29 are installed on one side and on the other with respect to the pin 34, for example in a symmetrical position with respect to the latter.

The particular configuration of the motorized rolls 29 installed on the pivoting chock 35 guarantees that the wires F1 and F2 are always gripped with both the motorized rolls 29 and the contrast roll 30, even if the wires F1 and F2 have discontinuities or irregularities in size.

According to a variant, not shown, there can be, for example, three motorized rolls 29, located adjacent to each other, and in which the third roll is intermediate between the two external ones.

In the case of a third roll, according to a variant, it can be in axis with the oscillation pin 34 of the pivoting chock 35.

In accordance with the variant embodiment shown in FIG. 2, the drawing and yielding assembly 13 comprises at least one motor 36, in this case two motors 36 each connected to a motorized roll 29 to make it rotate around its own axis.

According to a variant embodiment, not shown, both the motorized rolls 29 can be driven by a single motor 36.

In the latter case, means can be provided to adjust the time of the advance of the motorized rolls 29 depending on the specific needs that occur during the work. The adjustment assemblies can be elastic and/or tracking.

If the drawing and yielding assembly 13 comprises a motor 36 for each motorized roll 29, a coordinated drive of the latter can be provided, for example to induce a traction condition on the wires F1 and F2. For example, it can be provided that the motorized roll 29 located downstream is made to rotate at a slightly higher speed, for example by 1%-5% greater than that of the motorized roll 29 located upstream. This increases the efficiency of the straightening and linearization of the wires F1 and F2.

The motorized rolls 29 are each provided with a first circumferential seating 37 and at least a second circumferential seating 38, each suitable to receive one of the two wires F1, F2.

In accordance with the embodiments shown in FIGS. 3-5, the motorized rolls 29 are made in a single body and each comprise the first circumferential seating 37 and the second circumferential seating 38.

According to a variant embodiment, not shown, the first circumferential seating 37 and the second circumferential seating 38 can each be made on a respective roll, of which at least one of the rolls is motorized. In this case the drawing and yielding assembly 13 comprises at least a first pair of rolls and a second pair of rolls, subsequent to the first pair, both cooperating on the periphery of the contrast roll 30.

According to this variant embodiment, it can be provided that the first circumferential seating 37 and the second circumferential seating 38 are separate and autonomous, possibly connected with circumferential elastic means to absorb possible temporary delays of one seating with respect to the other seating.

A first positioning member 39 (FIG. 2) is associated with the contrast roll 30, and is configured to move the contrast roll 30 in a first direction W parallel to the axis of rotation R of the contrast roll 30 itself.

The first positioning member 39 allows to define at least three operating conditions of the contrast roll 30 and therefore of the multifunction work apparatus 10.

In particular, it is possible to provide:

- a first operating condition, shown in FIG. 3, in which the contrast roll 30 cooperates both with the first circumferential seatings 37 and also with the second circumferential seatings 38 of the two motorized rolls 29, defining a yielding and synchronized drawing action on both the wires F1 and F2;
- a second operating condition, shown in FIG. 4, in which the contrast roll 30 cooperates only with the first circumferential seatings 37 of the motorized rolls 29 determining an advance, and the yielding induction on the first wire F1; the second wire F2 remains stationary and is not drawn;
- a third operating condition, shown in FIG. 5, in which the contrast roll 30 cooperates only with the second circumferential seatings 38 of the motorized rolls 29 determining an advance, and the yielding induction on the second wire F2; the first wire F1 remains stationary and is not drawn.

In particular, as can be seen from FIGS. 4 and 5, the first positioning member 39 positions the contrast roll 30 in a condition of non-interference, or non-contact, with the second wire F2 (FIG. 4) and, respectively, with the first wire F1 (FIG. 5).

According to possible solutions, the contrast roll 30 can be provided with a first 41, a second 42 and a third annular portion 43 which is interposed between the first 41 and the second annular portion 42.

The annular portions 41, 42, 43 can be separated from each other by circumferential incisions 61 made in the contrast roll 30.

In the first operating condition (FIG. 3), the wires F1 and F2 are pressed by the contrast roll 30 with the first 41 and the second annular portion 42. In the second and third operating conditions (FIGS. 4 and 5) the contrast roll 30 is in contact with the first wire F1, or with the second wire F2, with the third annular portion 43.

According to a possible variant embodiment, the contrast roll 30 can be provided, instead of with the annular portions 41, 42 and 43, with at least a first circumferential seating and at least a second circumferential seating, each suitable to receive a respective wire F1, F2.

The first positioning member 39 comprises a support body 44 (FIG. 1) installed on longitudinal guides 45 (FIG. 2) disposed parallel to the axis of rotation R of the contrast roll 30.

A linear actuator 46, for example an electric or hydraulic jack, is connected to the support body 44, and is configured to move the support body 44 along the longitudinal guides 45.

The contrast roll 30 is associated with the support body 44 and the actuation of the linear actuator 46 determines the translation of the contrast roll 30 in the first direction W.

In accordance with possible solutions, the contrast roll 30 can be associated with a second positioning member 40 provided to move the contrast roll 30 in a direction orthogonal to the work direction Z and to the axis of rotation R of the contrast roll 30, that is according to the direction indicated by the arrow G in FIG. 1.

The second positioning member 40 allows to move the contrast roll 30 nearer to/away from the motorized rolls 29, to regulate the pressure exerted by the contrast roll 30 and by the motorized rolls 29 on the wires F1 and F2, and to allow for example the introduction operations of the latter.

In the working condition, the contrast roll 30 is pressed toward the motorized rolls 29 to generate respective yielding and linearization loops in the wires F1 and F2.

The thrust exerted by the contrast roll 30 can have a predetermined value, for example depending on the physical-chemical characteristics of the wires F1 and F2.

According to a possible embodiment, the contrast roll 30 can be installed on a support chock 47 installed sliding on transverse guides 48 installed parallel to the arrow G.

The second positioning member 40 can comprise a linear actuator 49 provided to move the support chock 47 along the transverse guides 48, and therefore the contrast roll 30 nearer to/away from the motorized rolls 29.

The transverse guides 48 can be installed on the support body 44.

In association with the drawing and yielding assembly 13, another exit roll 52 is provided, which can be positioned downstream and in direct proximity to a second of the motorized rolls 29 and configured to generate another straightening loop which winds around the second motorized roll 29.

With the term in direct proximity we mean that between the motorized roll 29 and the exit roll 52 there are no further deviating elements of the wires that are processed. The presence of the exit roll 52 allows to bend the wires F1 and F2 which are processed toward the motorized rolls 29, thus increasing the winding amplitude of the wires F1 and F2 around the motorized rolls 29. This allows to increase the drawing action of the wires F1 and F2 by the action of the motorized rolls 29.

Downstream of the drawing and yielding assembly 13 a finishing assembly 14 is installed, provided with rolls configured to generate further loops in the wires F1 and F2 and to induce further yielding tensions of a lower entity than those induced by the drawing and yielding assembly 13, and suitable to linearize the wires F1 and F2 more finely.

The exit roll 52 can be installed on the finishing assembly 14 and/or be an integral part of the latter.

In accordance with a possible solution, the finishing assembly 14 comprises a first finishing device 50 and a second finishing device 54 configured to generate finishing loops on a plane parallel and orthogonal to the lying plane of the axes of the motorized rolls 29.

The first finishing device 50 and the second finishing device 54 are installed on a support chock 57 mobile along guides 58 attached to a frame 59.

The frame 59 can be associated in a stable manner both with the frame 31 and with the frame 26 to define, in its entirety, said base frame 15.

The guides 58 are orthogonal to the work direction Z and to the axis of the fixed rolls 55.

An actuation member 60 is associated with the support chock 57 in order to move the support chock 57, and therefore the first finishing device 50 and the second finishing device 54 in a direction orthogonal to the work direction Z and to the axis of the rolls of the first finishing device 50 and of the second finishing device 54.

This movement allows the first finishing device 50 and the second finishing device 54 to generate finishing loops on the wires F1 and F2 on a plane parallel to the lying plane of the rolls.

According to a variant embodiment, the first finishing device 50 comprises a finishing roll 51, opposite to the exit roll 52, with respect to the work direction Z, and selectively mobile in a direction parallel to its axis of rotation, in the direction indicated by the arrow P in FIG. 2.

A movement member 53 is connected to the finishing roll 51, for example a linear actuator, configured to move the finishing roll 51 in the direction of the arrow P, that is parallel to the axis of the finishing roll 51, so as to generate the loop on a horizontal plane, with a desired constant or variable value depending on the requirements of linearization as possibly detected by specific sensors, not shown.

The finishing roll 51 is also provided with circumferential grooves to contain and guide the wires F1 and F2 during the movement.

The second finishing device 54 comprises two fixed rolls 55 positioned on a first side of the wires F1, F2 and a mobile roll 56 disposed on the opposite side of the wires F1 and F2 and in an intermediate position between the fixed rolls 55.

The mobile roll 56 can be moved toward/away from the fixed rolls 55 to generate a desired amplitude of the finishing loop of the wires F1 and F2.

According to the embodiment shown in FIG. 1, the mobile roll 56 is installed on the support chock 57.

In association with the support chock 57, at least one regulator 62 is present, which defines another positioning action of the mobile roll 56 with respect to the fixed rolls 55.

The positioning keeps the mobile roll 56 in position, fixed or elastically contrasted.

The regulator 62 acts on a lever 63 which is vertically pivoting and which supports the mobile roll 56 at one end.

According to a possible variant embodiment, the mobile roll 56 can be defined by a pair of rolls each associated with a respective regulator 62 and each provided to act on a respective wire F1, F2. The independent regulator 62 allows to obtain a differentiated finishing action on each wire F1 and F2.

As it is possible to understand, the invention finds its minimal formulation in various conditions.

It could thus have the assemblies 11, 12 and 13 with the exit roll 52, or it could have the assemblies 11, 13 and 14, or again it could have other combinations in relation to the results to be obtained and/or the type of wire F1, F2 processed.

It is clear that modifications and/or additions of parts can be made to the multifunction work apparatus 10 as described heretofore, without departing from the field and scope of the present invention.

It is also clear that, although the present invention has been described with reference to some specific examples, a person of skill in the art shall certainly be able to achieve many other equivalent forms of multifunction work apparatus 10, having the characteristics as set forth in the claims and hence all coming within the field of protection defined thereby.

The invention claimed is:

1. A drawing and yielding assembly, comprising: only a single lower contrast roll, the contrast roll being an idle roll and rotatable around its axis of rotation, the contrast roll being vertically adjustable relative to a base frame in a direction orthogonal to the axis of rotation, and at least two motor-driven upper motorized rolls positioned on a periphery of said contrast roll to define passage gaps for passage of wires, wherein a first one of the motorized rolls is positioned upstream relative to a work direction and a second one of the motorized rolls is positioned downstream relative to the work direction, and in that said contrast roll has a diameter larger than a diameter of each of said motorized rolls.

2. The drawing and yielding assembly as in claim 1, wherein said motorized rolls are installed on a chock horizontally pivoting around a pin with a pivoting axis parallel to axes of rotation of said motorized rolls, and parallel to the axis of rotation of said contrast roll.

3. The drawing and yielding assembly as in claim 1, wherein said motorized rolls are each provided with a first circumferential seating and at least a second circumferential seating, each circumferential seating suitable to receive a respective wire.

4. The drawing and yielding assembly as in claim 1, wherein said contrast roll is provided with a first circumferential seating and at least a second circumferential seating, each circumferential seating suitable to receive a respective wire.

5. The drawing and yielding assembly as in claim 3, wherein a first positioning member is associated with said contrast roll and is configured to move said contrast roll in a direction parallel to said axis of rotation of said contrast roll, in order to define at least:

a first operating condition, in which said contrast roll cooperates with said first circumferential seatings and said second circumferential seatings of said motorized rolls, a second operating condition, in which said contrast roll cooperates only with said first circumferential seatings of said motorized rolls, and a third operating condition, in which said contrast roll cooperates only with said second circumferential seatings of said motorized rolls.

6. The drawing and yielding assembly as in claim 1, wherein said contrast roll is associated with a second positioning member provided to vertically adjust the contrast roll relative to the base frame.

7. The drawing and yielding assembly as in claim 1, wherein the diameter of said contrast roll is between 1.5 and 3 times the diameter of said motorized rolls.

8. A multifunction work apparatus comprising the drawing and yielding assembly as in claim 1, and further including at least one of either a wire guide assembly, a straightening assembly, or a finishing assembly, each of the guide assembly, the straightening assembly, and the finishing assembly being aligned along a work direction.

9. The apparatus as in claim 8, wherein upstream of said drawing and yielding assembly, said straightening assembly can be disposed to induce a desired pre-yielding on said wires, said straightening assembly being provided with a first roll assembly installed in a fixed position and a second roll assembly opposite said first roll assembly and positionable in a direction orthogonal to the work direction in order to cooperate with said first roll assembly.

10. The apparatus as in claim 9, wherein said first roll assembly has a plurality of first straightening rolls and an exit roll located in direct proximity to the drawing and yielding assembly, in that said first straightening rolls and said exit roll are located, with respect to the work direction, on a side of said contrast roll, and in that said exit roll is configured to define with one of said motorized rolls a loop of said wire that winds around said motorized roll.

11. The apparatus as in claim 8, comprising another exit roll located downstream and in direct proximity to one of said motorized rolls in order to generate a straightening loop of said wires around said motorized roll.

12. The apparatus as in claim 8, wherein said finishing assembly is downstream of said drawing and yielding assembly, said finishing assembly being provided with a first finishing device and a second finishing device, the first finishing device configured to generate finishing loops of said wires on a plane parallel to a plane of the axes of the motorized rolls, and the second finishing device configured to generate finishing loops of said wires orthogonal to the plane of the axes of the motorized rolls.

13. The apparatus as in claim 8, comprising, aligned along the work direction, and in order, said wire guide assembly, said straightening assembly, said drawing and yielding assembly and said finishing assembly.

14. The apparatus as in claim 8, wherein at least one of either said straightening assembly, said drawing and yielding assembly or said finishing assembly comprises a frame to position components.

15. The apparatus as in claim 13, wherein said wire guide assembly, straightening assembly, drawing and yielding assembly and finishing assembly are all operatively coupled to the base frame.

16. The apparatus as in claim 8, wherein a detection device is associated with said contrast roll and is configured to detect a length of the wires.

17. The drawing and yielding assembly as in claim 1, wherein the diameter of said contrast roll exceeds the diameter of said motorized rolls by a ratio ranging from 1.8 to 2.5.

18. A drawing and yielding assembly, comprising:

a lower contrast roll, the contrast roll being an idle roll and rotatable around its axis of rotation, the contrast roll having first, second and third annular portions, the third annular portion disposed between the first and second annular portions, the contrast roll being vertically adjustable relative to a base frame in a direction orthogonal to the axis of rotation, and at least two motor-driven upper motorized rolls, the motorized rolls positioned on a periphery of said contrast roll to define passage gaps for passage of wires, and in that said contrast roll has a larger diameter larger than a diameter of each of said motorized rolls;

wherein a first one of the motorized rolls is positioned at an upstream location relative to a work direction and a second one of the motorized rolls is positioned at a separate downstream location relative to the work direction and spaced apart from the upstream location;

wherein said motorized rolls are each provided with a first circumferential seating and at least a second circumferential seating, each circumferential seating suitable to receive a respective wire; and wherein a first positioning member is associated with said contrast roll and is configured to move said contrast roll in a direction parallel to said axis of rotation of said contrast roll, in order to define at least:

a first operating condition, in which said contrast roll cooperates with said first circumferential seatings and said second circumferential seatings of said motorized rolls such that a first one of the wires is engaged between the first annular portion and the first circumferential seatings and a second one of the wires is engaged between the second annular portion and the second circumferential seatings, a second operating condition, in which said contrast roll cooperates only with said first circumferential seatings of said motorized rolls such that the first one of the wires is engaged between the third annular portion and the first circumferential seatings, and a third operating condition, in which said contrast roll cooperates only with said second circumferential seatings of said motorized rolls such that the second one of the wires is engaged between the third annular portion and the second circumferential seatings.

19. The drawings and yielding assembly of claim 18, wherein the first one of the motorized rolls applies power to one or more of the wires at the upstream location and the second one of the motorized rolls applies power to the one or more of the wires at the downstream location.

* * * * *